US008427400B2

(12) United States Patent
Kohno et al.

(10) Patent No.: US 8,427,400 B2
(45) **Date of Patent: *Apr. 23, 2013**

(54) IMAGE DISPLAY DEVICE

(75) Inventors: Tohru Kohno, Kokubunji (JP); Hajime Akimoto, Kokubunji (JP); Naruhiko Kasai, Yokohama (JP); Masato Ishii, Tokyo (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 994 days.

This patent is subject to a terminal disclaimer.

(21) Appl. No.: 12/477,158

(22) Filed: Jun. 3, 2009

(65) Prior Publication Data

US 2009/0303163 A1 Dec. 10, 2009

(30) Foreign Application Priority Data

Jun. 4, 2008 (JP) ..... 2008-146916

(51) Int. Cl.
*G09G 3/30* (2006.01)

(52) U.S. Cl.
USPC ..... 345/76; 345/77; 345/82; 345/84

(58) Field of Classification Search ..... 345/55, 345/76, 77, 80, 82, 83, 204, 205, 206, 211, 345/212
See application file for complete search history.

(56) References Cited

U.S. PATENT DOCUMENTS 6,747,639 B2 * 6/2004 So ..... 345/211
7,009,590 B2 3/2006 Numao
2003/0011314 A1 * 1/2003 Numao ..... 315/169.3
2005/0110720 A1 5/2005 Akimoto et al.
2006/0087247 A1 * 4/2006 Malmberg ..... 315/169.2
2006/0208671 A1 * 9/2006 Ozaki et al. ..... 315/371
2008/0150845 A1 6/2008 Ishii et al.
2009/0303162 A1 * 12/2009 Kohno et al. ..... 345/76

FOREIGN PATENT DOCUMENTS

JP 2002-341825 11/2002
JP 2005-156697 6/2005
JP 2006-130824 5/2006

* cited by examiner

*Primary Examiner* — William Boddie
*Assistant Examiner* — Sahlu Okebato
(74) *Attorney, Agent, or Firm* — Antonelli, Terry, Stout & Kraus, LLP.

(57) ABSTRACT

Provided is an image display device in which deterioration of a self-light-emitting element within a pixel is corrected accurately. A detection unit detects, within a detection period, a difference in characteristics between self-light-emitting elements of adjacent pixels. A first subtraction circuit outputs a differential voltage between a reference voltage and an image voltage to a self-light-emitting element that is determined by the detection unit as a deteriorated element. An amplifier amplifies an output of the first subtraction circuit with a gain $[1/\{1-(\alpha/100)\}]^{1/2}$ when a driver transistor is driven in a saturation region. The amplifier amplifies the output of the first subtraction circuit with a gain $[1/\{1-(\alpha/100)\}]$ when the driver transistor is driven in a linear region. A differential between the reference voltage and an output of the amplifier obtained by a second subtraction circuit is used as a corrected image voltage.

18 Claims, 17 Drawing Sheets

IMAGE DISPLAY DEVICE

CROSS-REFERENCE TO RELATED APPLICATION

The present application claims priority from Japanese application JP 2008-146916 filed on Jun. 4, 2008, the content of which is hereby incorporated by reference into this application.

BACKGROUND OF THE INVENTION

1. Field of the Invention

The present invention relates to an image display device, and more particularly, to an active matrix organic electroluminescence display.

2. Description of the Related Art

There are great expectations on organic electroluminescence displays (hereinafter referred to as organic EL display devices) which each include an organic electroluminescence display panel (hereinafter referred to as organic EL display panel) driven by active matrix driving, as flat panel displays of a next generation.

The organic EL display panel usually includes an organic electroluminescence element (hereinafter referred to as organic EL element) and a driving-use thin film transistor for supplying a current to the organic EL element (hereinafter referred to as EL driver TFT).

As illustrated in FIG. 13, applying a constant current to the organic EL element lowers element's brightness (Br of FIG. 13) with time (T of FIG. 13), and the drop is accompanied by a rise in an anode voltage (Voled of FIG. 13) of the organic EL element. As illustrated in FIG. 14, a rate of this brightness deterioration (Brate of FIG. 14) and an increment value (Vdeg of FIG. 14) of the anode voltage (Voled of FIG. 14) have a linear relationship.

Consider a case where an image of a white quadrangle (square) as illustrated in FIG. 15 is kept displayed. A part in which the white square is displayed deteriorates more quickly than a part in which black is displayed, thereby creating a difference in brightness between adjacent pixels. When this brightness difference exceeds 1%, the incident is recognized as burn-in as illustrated in an area A of FIG. 15.

A diagram of FIG. 16 is obtained by scanning the anode voltage (Voled of FIG. 16) of organic EL elements along one display line (certain Y address) in an organic EL display panel that contains the place of burn-in in order of the elements' X addresses (Xadres of FIG. 16). A point A of FIG. 16 indicates a start point of the burn-in. A range B of FIG. 16 indicates a normal area, and a range C of FIG. 16 indicates the area deteriorated by the burn-in.

Conventional technologies of preventing burn-in are disclosed in JP 2005-156697 A, JP 2002-341825 A, and JP 2006-130824 A described below.

Technologies described in JP 2005-156697 A and JP 2002-341825 A enable an organic EL element to emit light stably without allowing burn-in by putting results of current measurement through A/D conversion and, based on resultant digital data, performing feedback control on an organic EL element driving voltage.

A technology described in JP 2006-130824 A corrects the organic EL element driving voltage by measuring a terminal voltage of an organic EL element and comparing the measured voltage against a default value. This technology corrects an organic EL element driving current based on a relation between the terminal voltage and current of the organic EL element which is recorded in advance.

Problems of the technologies described in JP 2005-156697 A, JP 2002-341825 A, and JP 2006-130824 A are as follows.

(1) JP 2005-156697 A and JP 2002-341825 A do not contain a concrete description on a signal fed back from the organic EL element to the EL driver TFT, and how a correction signal is generated is not clear. The technologies described in JP 2005-156697 A and JP 2002-341825 A therefore do not ensure precise correction even when accurate detection operation is carried out.

(2) The technology disclosed in JP 2006-130824 A which uses a pre-recorded relation between the terminal voltage and current of an organic EL element to thereby correct the driving current needs a data table of enormous size for the correction.

SUMMARY OF THE INVENTION

The present invention has been made in view of the above-mentioned problems of prior art, and it is therefore an object of the present invention to provide a technology with which deterioration of a self-light-emitting element in an image display device can be corrected precisely.

The above-mentioned and other objects as well as novel features of the present invention become clear through the description given herein and the accompanying drawings.

Among aspects of the present invention disclosed herein, a representative one is briefly outlined as follows.

An image display device according to the present invention includes: a plurality of pixels each including a self-light-emitting element and a driver transistor for driving the self-light-emitting element, the driver transistor being driven in a saturation region; a plurality of signal lines through which an image voltage is input to the plurality of pixels; detection means for detecting a difference in characteristics between the self-light-emitting elements of two adjacent pixels among the plurality of pixels; a first calculation means for calculating a differential voltage between a reference voltage and the image voltage for the self-light-emitting element of the pixel that has been determined as a deteriorated self-light-emitting element by the detection means; a second calculation means for multiplying a result of calculation made by the first calculation means by a non-linear light emission correction amount; and a third calculation means for subtracting a result of calculation made by the second calculation means from the reference voltage to obtain a corrected image voltage.

The detection means may include: a constant current supplying circuit; a voltage detection circuit for detecting, within a detection period, a voltage across the self-light-emitting element of each of the plurality of pixels, which is observed when a constant current is supplied from the constant current supplying circuit to the self-light-emitting element of each of the plurality of pixels; an A/D converter for converting the voltage detected by the voltage detection circuit into a digital value; a memory for storing the digital value output from the A/D converter; and a determination circuit for detecting, based on the digital value stored in the memory, the difference in characteristics between the self-light-emitting elements of the two adjacent pixels, and determining the deteriorated self-light-emitting element.

In the image display device according to the present invention, when the determination circuit determines that an amount of deterioration in emission brightness of the self-light-emitting element is $\alpha$%, the light emission correction amount is $[1/\{1-(\alpha 100)\}]^{1/2}$, which is a non-linear function of $\alpha$, in a case where the driver transistor is driven in a saturation region, and the light emission correction amount is $[1/\{1-(\alpha/100)\}]$, which is a linear function of $\alpha$, in a case where the driver transistor is driven in a linear region.

Further, in the image display device according to the present invention, the first calculation means is a first subtraction circuit which outputs the differential voltage between the reference voltage and the image voltage, the second calculation means is an amplifier for amplifying, based on a determination of the determination circuit, an output of the first subtraction circuit with one of a gain $[1/\{1-(\alpha/100)\}]^{1/2}$ and a gain $[1/\{1-(\alpha/100)\}]$, and the third calculation means is a second subtraction circuit which outputs a differential voltage between the reference voltage and an output of the amplifier.

Further, in the image display device according to the present invention, the self-light-emitting element may be an organic light emitting diode element.

DETAILED DESCRIPTION OF THE INVENTION

An embodiment of the present invention is described below in detail with reference to the accompanying drawings.

Components having the same functions are denoted by the same reference symbols throughout the drawings that illustrate the embodiment, and repetitive descriptions are omitted.

Figure 1:
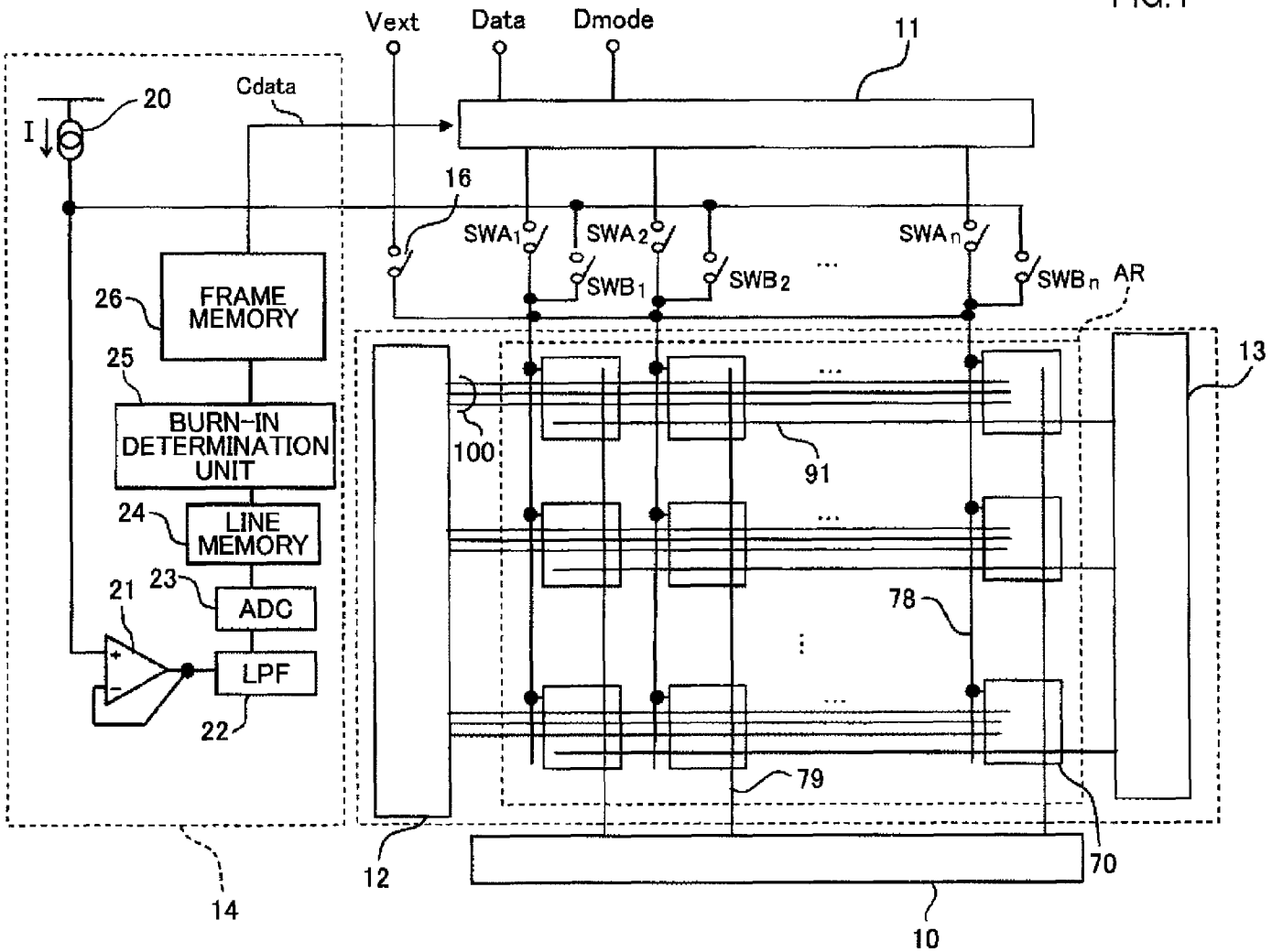
FIG. 1 is a diagram illustrating a schematic structure of an organic EL display panel with a built-in burn-in detection and correction function, which is an embodiment of the present invention.

FIG. 1 is a diagram illustrating a schematic structure of an organic EL display panel with a built-in burn-in detection and correction function according to the embodiment of the present invention.

In this embodiment, as illustrated in FIG. 1, a characteristics detection unit 14 first causes a constant current to flow from a current source 20 into each organic EL element, and detects the resultant anode voltage of the organic EL element through a buffer circuit 21 and a low pass filter 22. An analog-digital conversion circuit 23 converts the detected anode voltage into a digital value, which is stored in a line memory 24.

From the information stored in the line memory 24, a burn-in determination unit 25 calculates a differential between adjacent pixels to determine whether or not it indicates burn-in, and stores the determination in a frame memory 26. The frame memory 26 feeds correction data Cdata back to a signal driver circuit 11. Other data input to the signal driver circuit 11 are display data Data and mode switching data Dmode.

In FIG. 1, denoted by reference symbol "10" is a power supply circuit; "12", display-use scanning circuit; "13", detection-use scanning circuit; "16", external voltage control unit; "70", display pixel; "78", signal line; "79", power supply line; "91", detection control line; and "100", control signal line group. "Vext" represents an external power supply.

A switch SWA connects the signal line 78 to an assigned output terminal of the signal driver circuit 11 in a "write period". A switch SWB connects the signal line 78 to the current source 20 within the characteristics detection unit 14 in a "detection period". The external voltage control unit 16 connects the signal line 78 to the external power supply Vext in a "light emission period". The external power supply supplies, for example, a triangular wave voltage or a sawtooth wave voltage.

The display pixel 70, the signal driver circuit 11, the display-use scanning circuit 12, the detection-use scanning circuit 13, and other circuits are all formed on a glass substrate with the use of a low-temperature polycrystalline silicon thin film of well known type. A plurality of display pixels 70 are arranged in matrix within a display area AR of the organic EL display panel as illustrated in FIG. 1.

Figure 2:
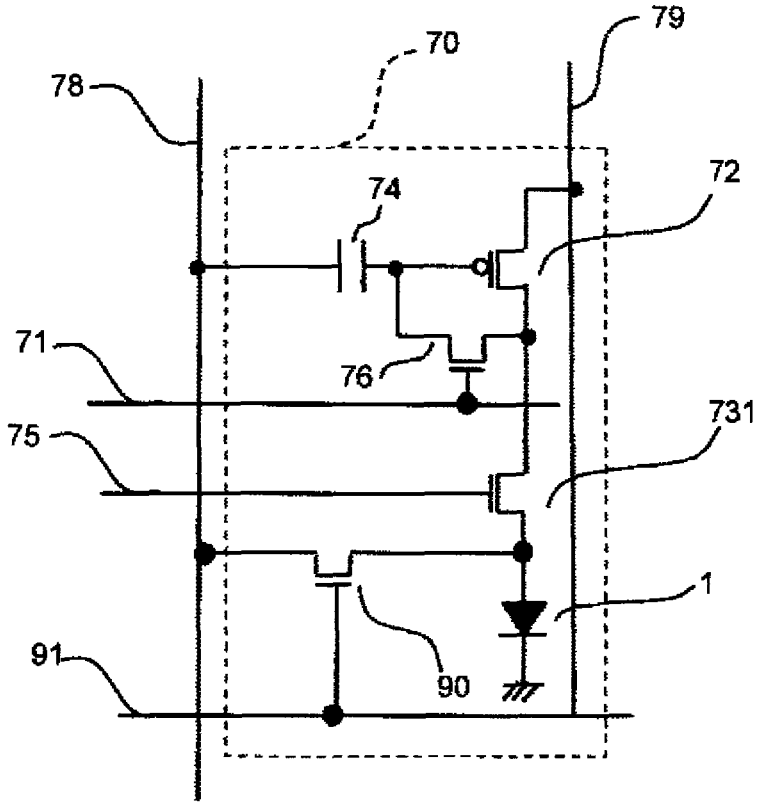
FIG. 2 is a diagram illustrating an equivalent circuit as an example of a display pixel that is used in the organic EL display panel of FIG. 1.

FIG. 2 is a diagram illustrating an equivalent circuit as an example of the display pixel 70 inside the organic EL display panel of FIG. 1. In the case of the display pixel of FIG. 2, the control signal line group 100 illustrated in FIG. 1 includes a selection control line 71 and a lighting switch line 75. The selection control line 71 and the lighting switch line 75 are connected to the display-use scanning circuit 12. The detection control line 91 is connected to the detection-use scanning circuit 13.

Each display pixel 70 includes an organic EL element 1 as a light emitting element. The organic EL element 1 has a cathode electrode connected to a common ground line, and an anode electrode connected to the power supply line 79 through a lighting-use n-type thin film transistor (hereinafter referred to as lighting TFT switch) 731 and a p-type thin film transistor (hereinafter referred to as driver TFT) 72. The power supply line 79 is connected to the power supply circuit 10.

A gate electrode of the driver TFT 72 is connected to the signal line 78 through a storage capacitor 74. A reset-use n-type thin film transistor (hereinafter referred to as selector switch) 76 is connected between a drain electrode of the driver TFT 72 and the gate electrode of the driver TFT 72. A gate electrode of the selector switch 76 is connected to the selection control line 71. A gate electrode of the lighting TFT switch 731 is connected to the lighting switch line 75.

A thin film transistor 90 for detecting the inter-terminal voltage of the organic EL element 1 (the thin film transistor is hereinafter referred to as detection switch) is connected between the anode electrode of the organic EL element 1 and the signal line 78. A gate electrode of the detection switch 90 is connected to the detection control line 91.

The driver TFT 72, the lighting TFT switch 731, the selector switch 76, and the detection switch 90 are each formed on the glass substrate with the use of a polycrystalline silicon thin film transistor having a semiconductor layer that is made of polysilicon. The polycrystalline silicon thin film transistors and the organic EL element 1 are manufactured by methods that do not greatly differ from commonly reported ones, and descriptions on the methods are omitted here.

In the case of the organic EL display panel including the display pixel 70 of FIG. 2, one frame period which is set in advance to 1/60 second is divided into three periods, for example, a "write period", a "light emission period", and a "detection period".

The organic EL display panel including the display pixel 70 of FIG. 2 is driven by a well-known method, and a description on the method is omitted here.

Figure 3:
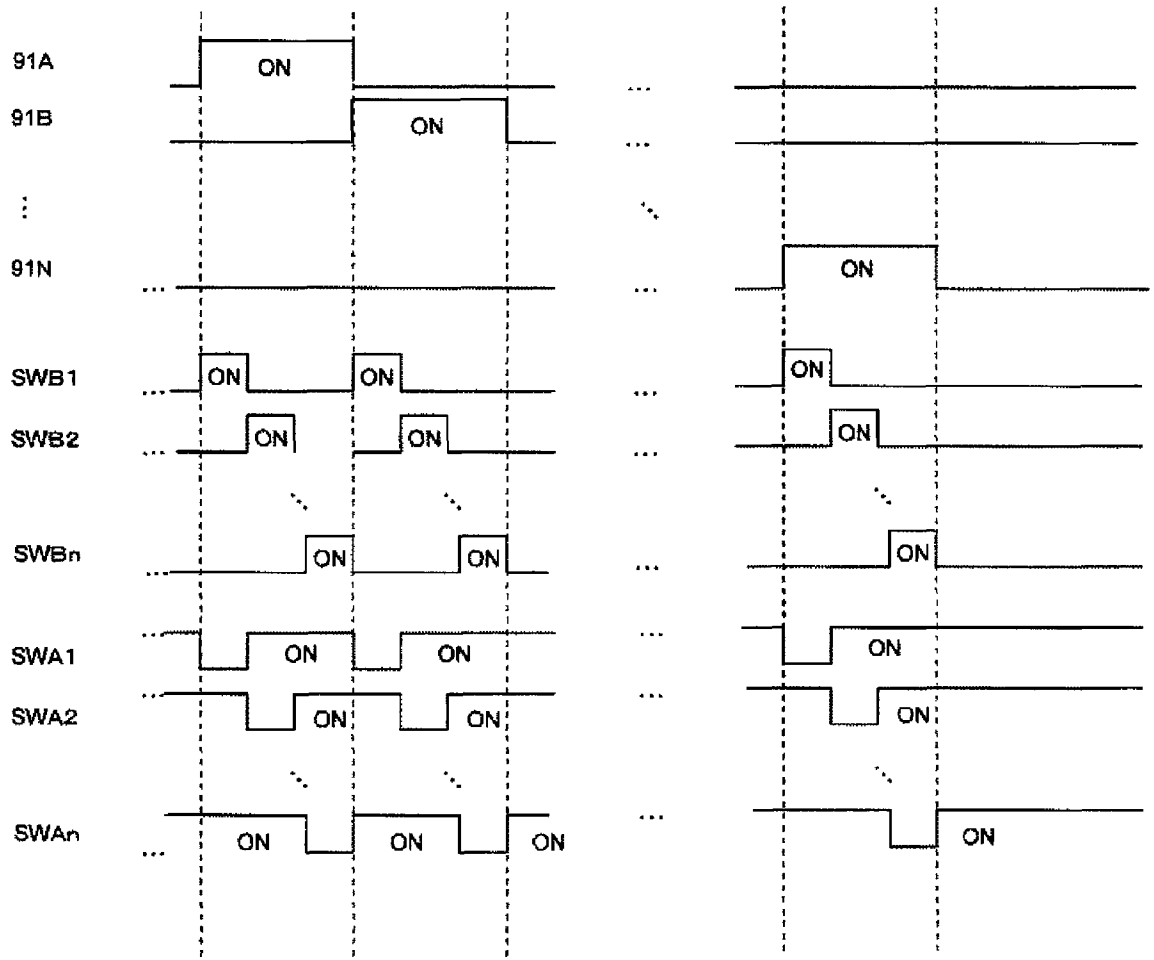
FIG. 3 is a timing chart illustrating an example of how components of the display pixel of FIG. 2 operate in a "detection period"

However, with the organic EL display panel including the display pixel 70 of FIG. 2, the detection control lines 91A through 91N are sequentially turned on in a "detection period" and, in a period in which each detection control line is ON, the switches SWB1 through SWBn are sequentially switched on as illustrated in FIG. 3.

This causes a constant current to flow from the current source 20 within the characteristics detection unit 14 into the respective organic EL elements 1 sequentially, and the characteristics detection unit 14 detects the anode voltage of each organic EL element 1.

Figure 4:
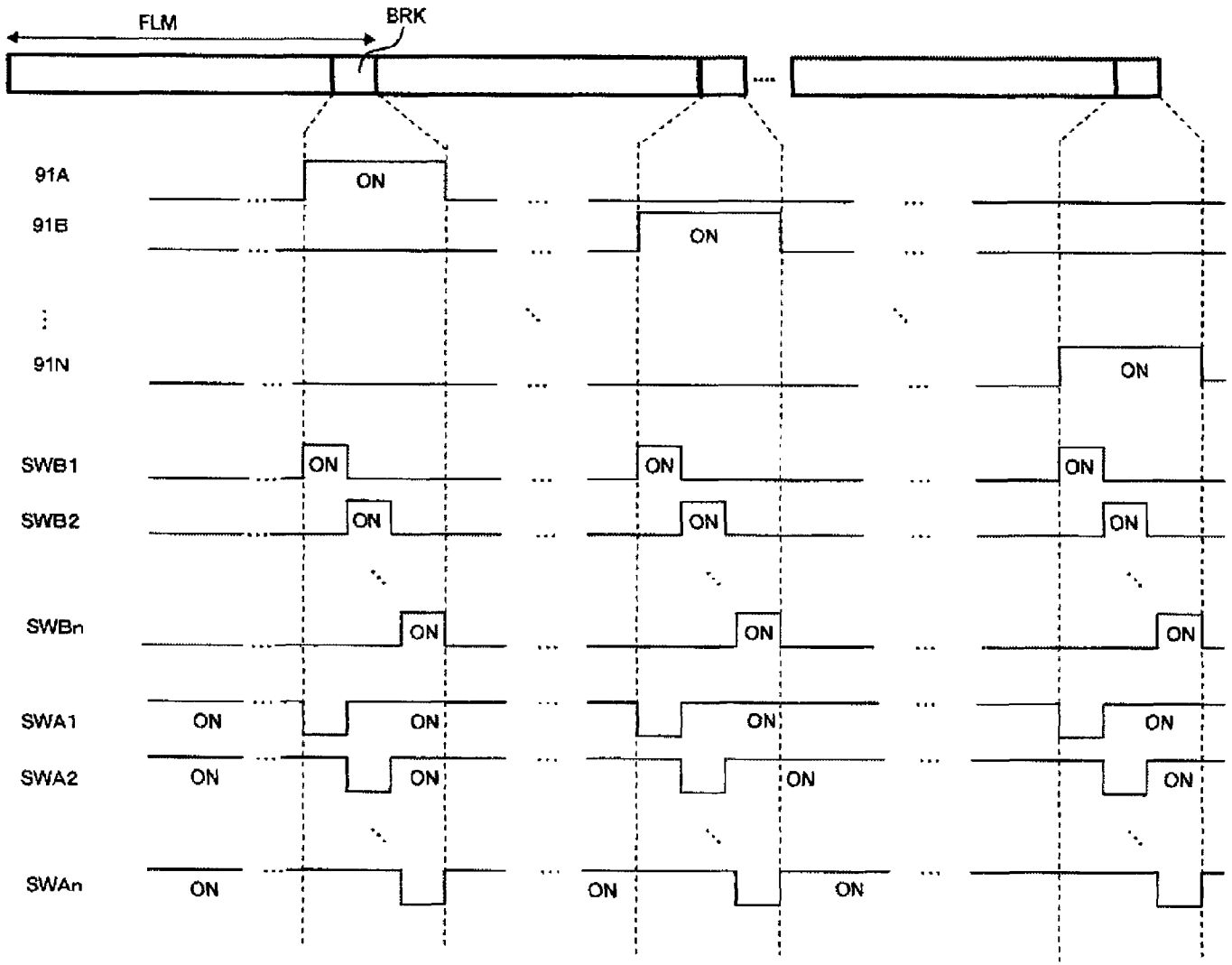
FIG. 4 is a timing chart illustrating another example of how components of the display pixel of FIG. 2 operate in a "detection period"

The "detection period" may be set in a branking period (BRK) within one frame (FLA) as illustrated in FIG. 4.

In FIG. 4, the detection control lines 91A through 91N are sequentially turned on in each branking period (BRK) and, in a period in which each detection control line is ON, the switches SWB1 through SWBn are sequentially switched on. This means that, in FIG. 4, the organic EL elements 1 along one display line are checked in each branking period (BRK).

Figure 5:
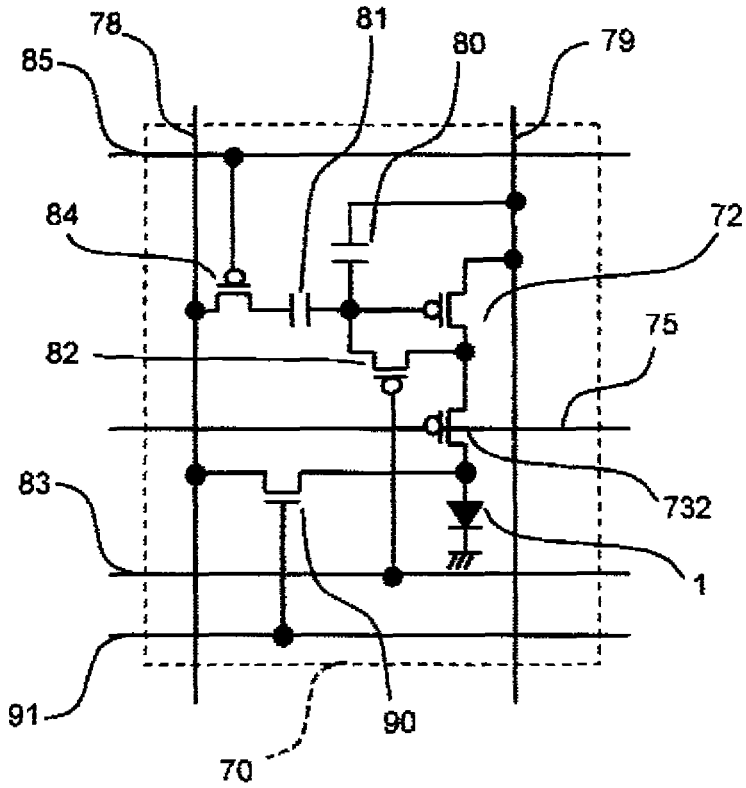
FIG. 5 is a diagram illustrating an equivalent circuit as another example of the display pixel that is used in the organic EL display panel of FIG. 1.

FIG. 5 is a diagram illustrating an equivalent circuit as another example of the display pixel 70 inside the organic EL display panel of FIG. 1.

In the case of the display pixel of FIG. 5, the control signal line group 100 illustrated in FIG. 1 includes the lighting switch line 75, a reset line 83, and a selector switch line 85. The lighting switch line 75, the reset line 83, and the selector switch line 85 are connected to the display-use scanning circuit 12. The detection control line 91 is connected to the detection-use scanning circuit 13.

Each display pixel 70 includes the organic EL element 1. The organic EL element 1 has a cathode electrode connected to a common ground line, and an anode electrode connected to the power supply line 79 through a lighting-use p-type thin film transistor (hereinafter referred to as lighting TFT switch) 732 and the p-type thin film transistor (hereinafter referred to as driver TFT) 72. The power supply line 79 is connected to the power supply circuit 10.

A first storage capacitor 80 is connected between a source electrode and gate electrode of the driver TFT 72. The gate electrode of the driver TFT 72 is connected to the signal line 78 through a second storage capacitor 81 and a p-type thin film transistor (hereinafter referred to as selector switch) 84.

A reset-use n-type thin film transistor (hereinafter referred to as resetting TFT switch) 82 is provided between a drain electrode of the driver TFT 72 and the gate electrode of the driver TFT 72. Agate electrode of the selector switch 84 is connected to the selector switch line 85. A gate electrode of the resetting TFT switch 82 is connected to the reset line 83. A gate electrode of the lighting TFT switch 732 is connected to the lighting switch line 75.

The thin film transistor 90 for detecting the inter-terminal voltage of the organic EL element 1 (the thin film transistor is hereinafter referred to as detection switch) is connected between the anode electrode of the organic EL element 1 and the signal line 78. A gate electrode of the detection switch 90 is connected to the detection control line 91.

The driver TFT 72, the lighting TFT switch 732, the selector switch 76, and the detection switch 90 are each formed on the glass substrate with the use of a polycrystalline silicon thin film transistor having a semiconductor layer that is made of polysilicon. The polycrystalline silicon thin film transistors and the organic EL element 1 are manufactured by methods that do not greatly differ from commonly reported ones, and descriptions on the methods are omitted here.

In the case of the organic EL display panel including the display pixel 70 of FIG. 5, one frame period which is set in advance to 1/60 second is divided into a "write period" and a "light emission period". The organic EL display panel including the display pixel 70 of FIG. 5 is driven by a well-known method, and a description on the method is omitted here.

However, the organic EL display panel including the display pixel 70 of FIG. 5 has an advantage due to the selector switch 84 placed between the signal line 78 and the second storage capacitor 81. The advantage is that most of one frame period can be allocated to the light emission period. Meanwhile its detection operation is limited to independent operation as the one illustrated in FIG. 3, and the detection operation as the one illustrated in FIG. 3 is incorporated in, for example, operation executed when the organic EL display panel is powered on.

The peripheral driver circuits including the signal driver circuit 11, the display-use scanning circuit 12, and the detection-use scanning circuit 13, which are low-temperature polycrystalline silicon (polysilicon) thin film transistor circuits in the above-mentioned description, may be entirely or partially single crystal large scale integrated circuits (LSIs). In this case, the driver TFT, the lighting TFT switch, the reset switch, the detection switch, and other thin film transistors may each be formed on a glass substrate with the use of an amorphous silicon thin film transistor having a semiconductor layer that is made of amorphous silicon.

Figure 6:
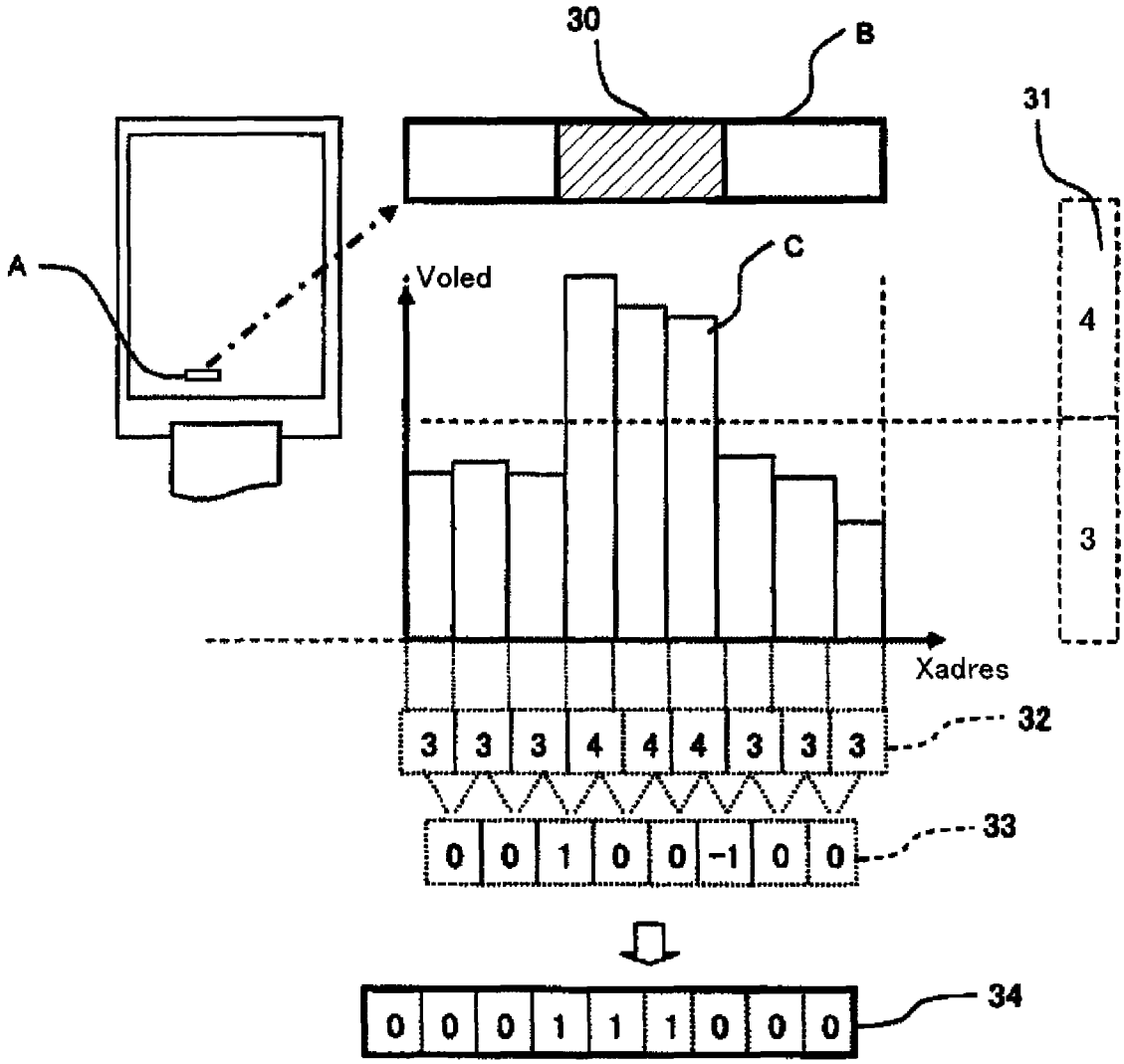
FIG. 6 is an explanatory diagram illustrating details of processing that is executed by a burn-in determination unit illustrated in FIG. 1.

FIG. 6 is a diagram illustrating details of processing that is executed by the burn-in determination unit 25 of FIG. 1.

A rectangular region B illustrated in FIG. 6 is an enlarged view of a part A of the organic EL display panel, and illustrates that burn-in 30 has occurred in this region B.

As described above, the characteristics detection unit 14 causes a constant current to flow from the current source 20 to an organic EL element and detects the anode voltage of the organic EL element. A bar graph C located below the region B of FIG. 6 illustrates results of detecting the anode voltage of each organic EL element in the region B. The horizontal axis of the graph C is for the horizontal direction location (Xadres) in the region B. A bar 31 in the graph C represents a digital value corresponding to the detected anode voltage. Specifically, the bar 31 illustrates that an anode voltage that exceeds a threshold indicated by the horizontal dotted line in the graph C is converted into "4" whereas an anode voltage that is equal to or lower than the threshold is converted into "3". A sequence 32 illustrated below the graph C indicates digital values output from the analog-digital conversion circuit 23 as values that correspond to the anode voltages illustrated in the graph C.

The burn-in determination unit 25 of FIG. 1 uses the digital values 32 output from the analog-digital conversion circuit 23 to calculate a differential value 33 between two adjacent display pixels. A correction amount specific to each display pixel can be calculated by setting the correction amount of the leftmost display pixel as 0 and moving rightward for sequential processing in which adding the differential value to the correction amount of the display pixel that is to the left of the currently processed display pixel is repeated.

The organic EL element 1 is inherently large in terms of temperature characteristics, and has characteristics distribution as well which is dependent on the film thickness within the organic EL display panel. Therefore, the best way to determine whether or not burn-in has occurred is comparing the characteristics between adjacent pixels.

The description given next is about the light emission correction amount of the organic EL element 1 in which burn-in has been detected from a characteristics comparison between adjacent display pixels.

Figure 7:
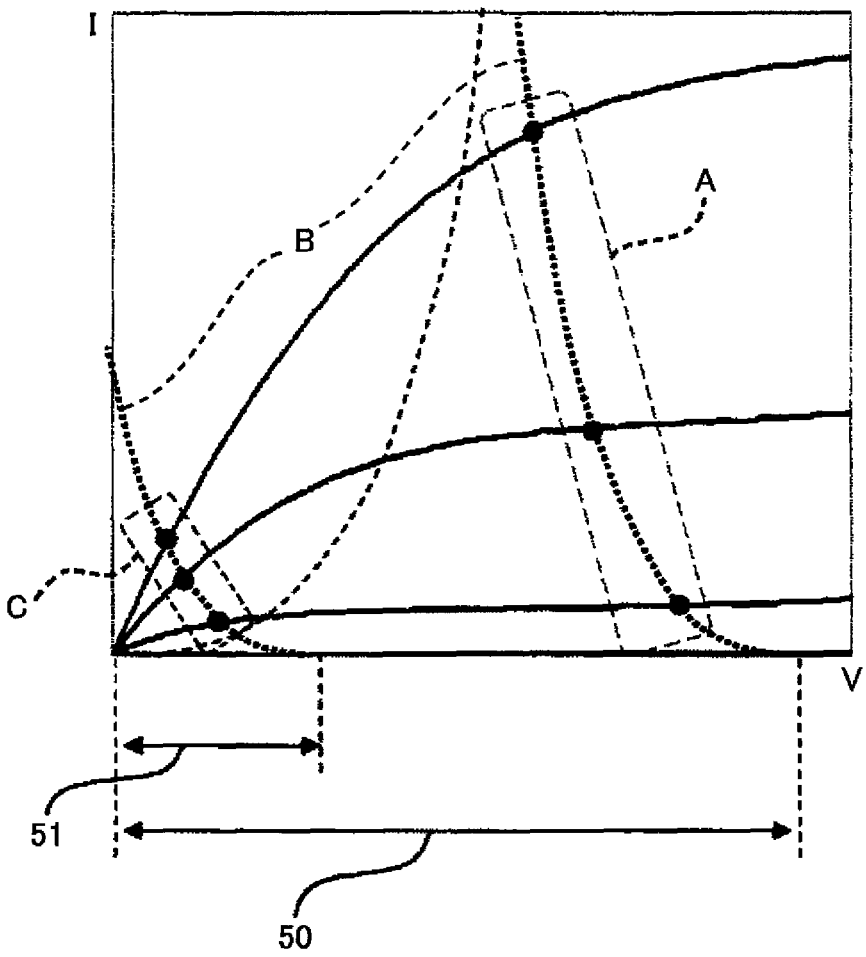
FIG. 7 is a schematic diagram illustrating driving operation regions of driver TFTs illustrated in FIGS. 2 and 5.

As illustrated in FIG. 7, a driving method for the driver TFT 72 of FIGS. 2 and 5 can be divided by an operation region into driving in a saturation region (hereinafter referred to as current driving method) and driving in a linear region (hereinafter referred to as voltage driving method).

(1) Driving the driver TFT 72 by the current driving method (operation in a region A of FIG. 7)

In the current driving method, a current I1 which flows into the driver TFT 72 when the organic EL element 1 is to emit light is expressed by the following Expression (1).

$$I1=(1/2)\cdot\mu\cdot Cox\cdot(W/L)\cdot(Vref-Vdata)^2\cdot(1+\lambda\cdot Vds1) \quad (1)$$

where μ·Cox represents a constant, W represents the gate width of the driver TFT 72, L represents the gate length of the driver TFT 72, Vref represents a reference voltage, and Vdata represents an image voltage which corresponds to display data. 1/λ is the Early voltage. Vds1 in Expression (1) represents the drain-source voltage of the driver TFT 72 that is observed when the current I1 flows in the driver TFT 72.

A current I2 which flows in the driver TFT 72 when the organic EL element 1 emits light at a brightness deteriorated by 1% is expressed by Expression (2) given below. A first equality in Expression (2) is based on the fact that the current I2 is smaller than the current I1 by 1% in keeping with the brightness deterioration. A second equality in Expression (2) is based on an expression of current in the current driving method which is similar to Expression (1). In the second equality, Vds2 represents the drain-source voltage of the driver TFT 72 that is observed when the brightness has deteriorated by 1% due to a rise in the anode voltage Voled of the organic EL element 1.

$$\begin{aligned} I2 &= 0.99\cdot I1 \\ &= (1/2)\cdot\mu\cdot Cox\cdot(W/L)\cdot(Vref-Vdata)^2\cdot(1+\lambda\cdot Vds2) \end{aligned} \quad (2)$$

From Expressions (1) and (2), a relational expression between Vds1 and Vds2 is obtained. This relational expression is used to obtain a corrected voltage V'data which makes the current I1 to flow in the driver TFT 72 when the source-drain voltage of the driver TFT 72 is Vds2. Specifically, Vdata of the right side of Expression (2) is replaced by V'data, the resultant expression and the right side of Expression (1) are connected by an equal mark, and the resultant equation is solved to obtain the following Expression (3):

$$V'data=Vref-(Vref-Vdata)\cdot(1/0.99)^{1/2} \quad (3)$$

(2) Driving the driver TFT 72 by the voltage driving method (operation in a region C of FIG. 7)

In the voltage driving method, a current I3 which flows into the driver TFT 72 when the organic EL element 1 is to emit light is expressed by the following Expression (4):

$$I3=\mu\cdot Cox(W/L)\cdot(Vref-Vdata)\cdot(Vds1) \quad (4)$$

A current I4 which flows in the driver TFT 72 when the organic EL element 1 emits light at a brightness deteriorated by 1% is expressed by Expression (5) given below. A first equality in Expression (5) is based on the fact that the current I4 is smaller than the current I1 by 1% in keeping with the brightness deterioration. A second equality in Expression (5) is based on an expression of current in the voltage driving method which is similar to Expression (4). In the second equality, Vds2 represents the drain-source voltage of the driver TFT 72 that is observed when the brightness has deteriorated by 1% due to a rise in the anode voltage Voled of the organic EL element 1.

$$\begin{aligned} I4 &= 0.99\cdot I3 \\ &= \mu\cdot Cox\cdot(W/L)\cdot(Vref-Vdata)\cdot(Vds2) \end{aligned} \quad (5)$$

From Expressions (4) and (5), a relational expression between Vds1 and Vds2 is obtained. This relational expression is used to obtain a corrected voltage V'data which makes the current I3 to flow in the driver TFT 72 when the source-drain voltage of the driver TFT 72 is Vds2. Specifically, Vdata of the right side of Expression (5) is replaced by V'data, the resultant expression and the right side of Expression (4) are connected by an equal mark, and the resultant equation is solved to obtain the following Expression (6):

$$V'data=Vref-(Vref-Vdata)\cdot(1/0.99) \quad (6)$$

As described above, there are two types of calculations for obtaining the corrected voltage V'data for two different driving methods of the driver TFT 72, and there are accordingly two types of correction circuits for obtaining the corrected voltage V'data. A first correction circuit is a circuit that obtains the corrected voltage V'data in the current driving method. This circuit obtains a differential between the reference voltage Vref and the image voltage Vdata as illustrated in Expression (3), multiplies the differential value by a recovery amount to the power of one half, and subtracts the product from the reference voltage Vref. A second correction circuit is a circuit that obtains the corrected voltage V'data in the voltage driving method. This circuit obtains a differential between the reference voltage Vref and the image voltage Vdata as illustrated in Expression (6), multiplies the differential value by a recovery amount, and subtracts the product from the reference voltage Vref.

In FIG. 7 which is a schematic diagram illustrating the driving operation regions of the driver TFT 72, I indicates current, V represents voltage, and the I-V characteristics of the driver TFT 72 are represented by a solid curve. Dotted curves B which cross the I-V characteristics curves in the regions A and C indicate the load characteristics of the organic EL element 1. A voltage range 50 and a voltage range 51 illustrated in FIG. 7 are a voltage range necessary for current driving and a voltage range necessary for voltage driving, respectively.

In the display pixel illustrated in FIG. 2 or FIG. 5, gradation characteristics are obtained by supplying a differential voltage between the external voltage and the image voltage (Vref−Vdata) of Expression (1) or Expression (4) to the display pixel through the signal line 78.

When an external voltage is applied, the display pixel of FIG. 2 or FIG. 5 first coordinates the initial operation point of the driver TFT 72 by controlling the selector switch 76 illustrated in FIG. 2 (or the resetting TFT switch 82 illustrated in FIG. 5) and the lighting TFT switch 731 or 732.

The lighting TFT switch 731 or 732 and the selector switch 76 (or the resetting TFT switch 82) are then sequentially turned off. Turning the selector switch 76 (or the resetting TFT switch 82) off shifts the initial operation point due to clock feedthrough.

Next, an image voltage is input to the signal line 78. A differential voltage between the initial operation point and the image voltage, or a voltage as high as part of this differential voltage created by voltage division, is added to the gate voltage of the driver TFT 72. Gradation characteristics are thus obtained.

In short, in Expressions (3) and (6), Vref is a voltage obtained by adding a voltage shift due to clock feedthrough in the display pixel to the external voltage, and Vdata is the image voltage.

A voltage shifted from the external voltage by the amount of change caused by clock feedthrough is hereinafter called a reference voltage.

Figure 17:
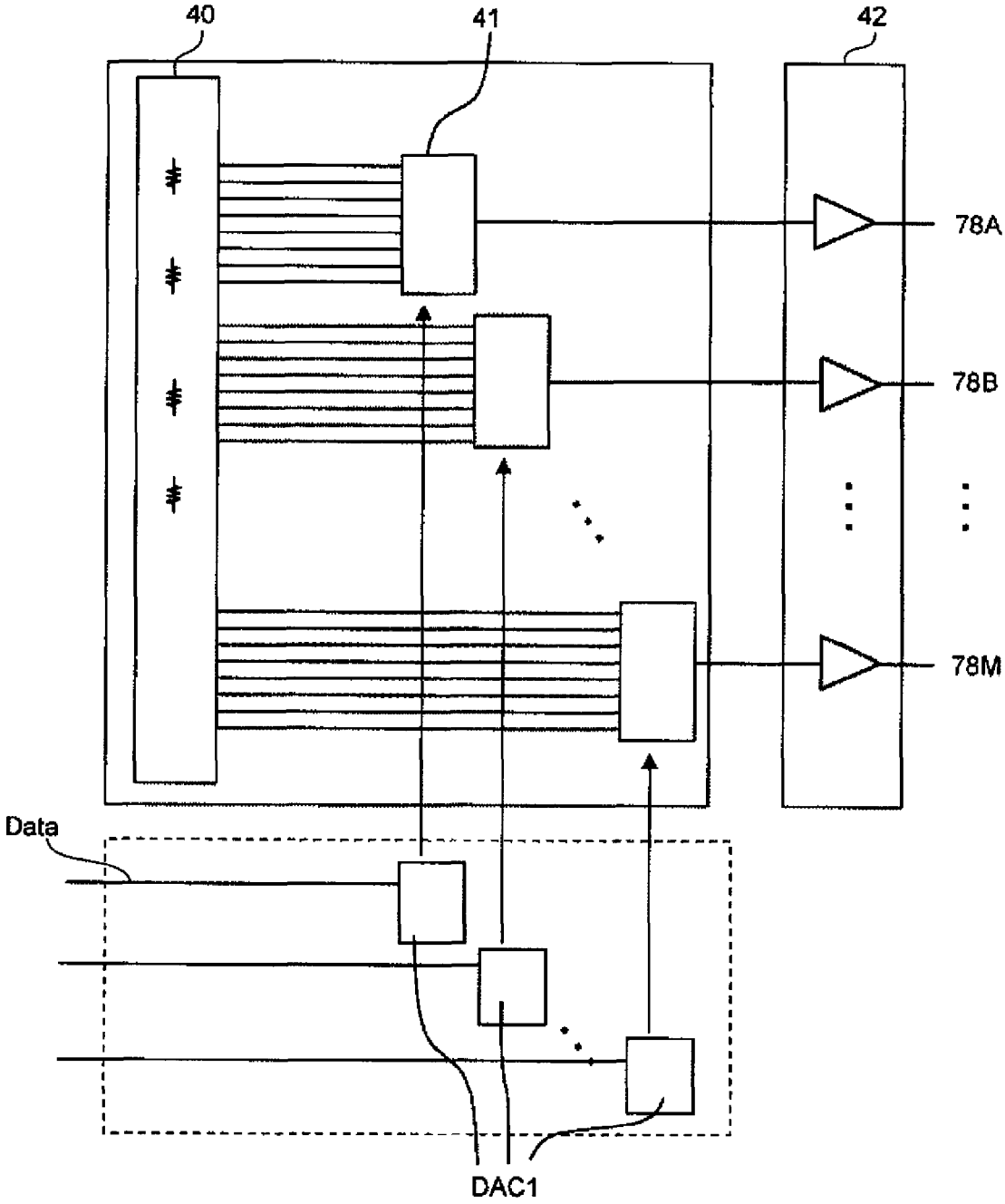
FIG.17 PRIOR ART
FIG. 17 is a block diagram illustrating a circuit structure that is conventionally employed for the output section of the signal driver circuit of FIG. 1.

FIG. 17 is a block diagram illustrating a circuit structure that is conventionally employed for an output section of the signal driver circuit 11 of FIG. 1.

As illustrated in FIG. 17, the output section of the conventional signal driver circuit 11 includes a resistor ladder unit 40, a selector 41, and an output amplifier unit 42. The selector 41 selects and outputs a voltage (gradation voltage) that corresponds to display data Data out of a plurality of voltages generated by the resistor ladder unit 40 according to the resistance division ratio, based on an output signal from a decoder DAC1 to which the display data Data is input. After being output from the selector 41, the gradation voltage that corresponds to the display data is output to the signal line 78 of the organic EL display panel through the output amplifier unit 42.

Figure 18:
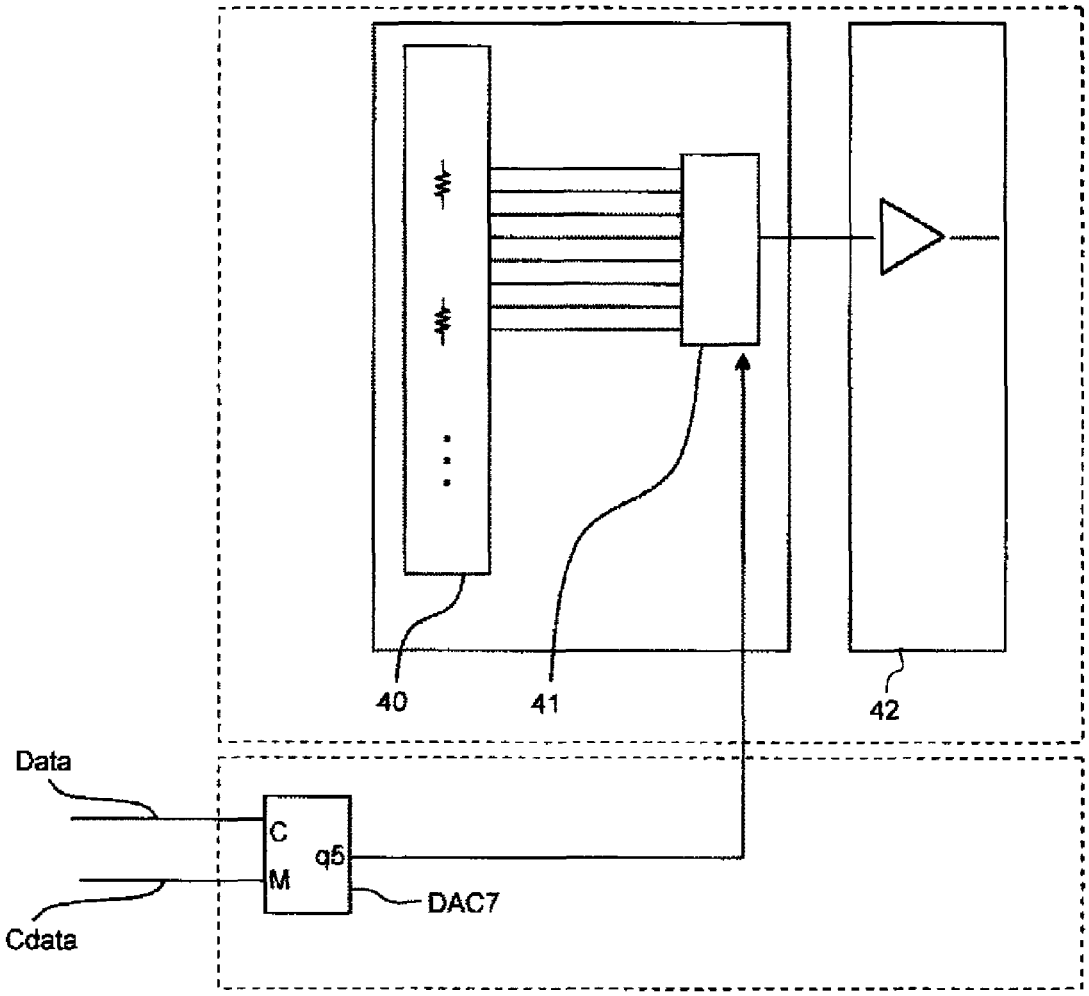
FIG.18 PRIOR ART
FIG. 18 is a block diagram illustrating a circuit structure of a burn-in correction circuit in a conventional organic EL element.

Conventional methods of correcting the burn-in of the organic EL element 1 include one in which a correction signal is fed back to the image voltage and one in which, as illustrated in FIG. 18, the resistance division ratio of the resistor ladder unit 40 selected by the selector 41 is changed based on an output of a decoder DAC7 to which the display data Data and the correction data Cdata are input.

FIG. 18 is a block diagram illustrating a circuit structure of a burn-in correction circuit of the conventional organic EL element 1. The circuit structure of FIG. 18 corrects the driving current with the use of a relation between the anode voltage of the organic EL element 1 (i.e., correction data Cdata) and the current (i.e., display data Data), which is stored in advance. A drawback of this method is that the decoder DAC7 needs to have a data table TB of enormous size inside.

Figure 8:
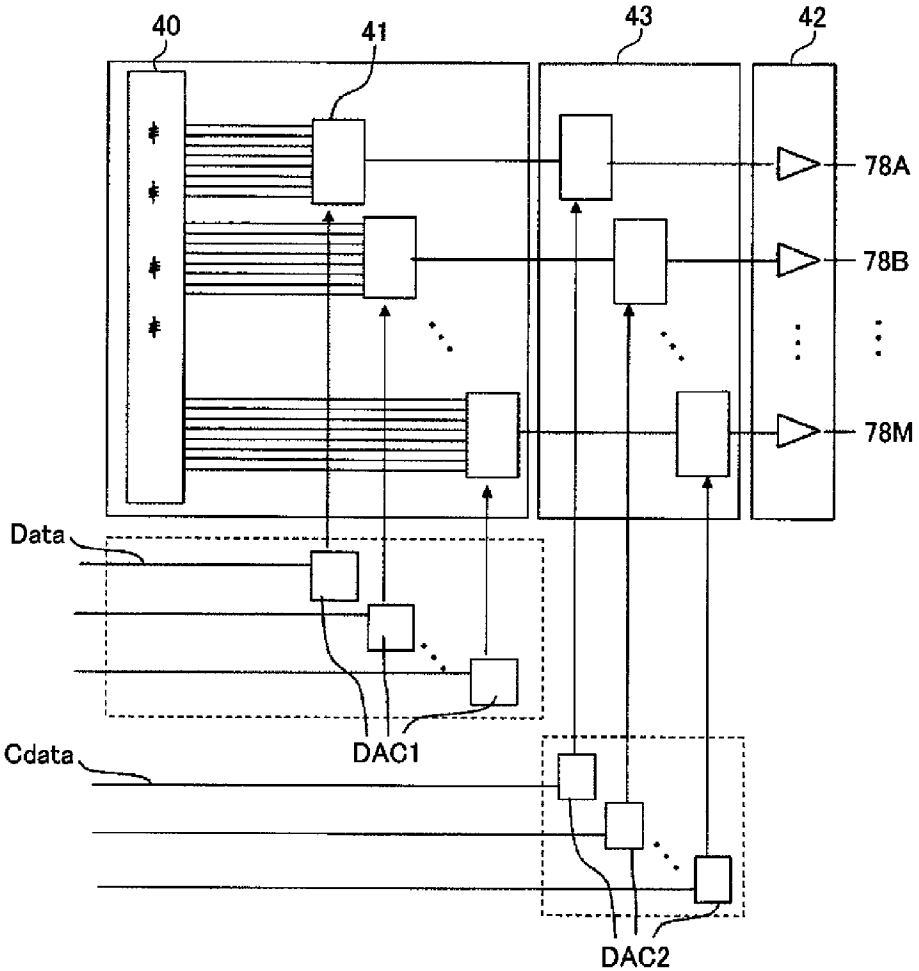
FIG. 8 is a block diagram illustrating a circuit structure of an output section of a signal driver circuit according to the embodiment of the present invention.

FIG. 8 is a block diagram illustrating a circuit structure of the output section of the signal driver circuit 11 according to the embodiment of the present invention.

The output section of FIG. 8 is obtained by adding a correction unit 43 to the output section of FIG. 17 upstream of the output amplifier unit 42. This correction unit 43 corrects an output of the selector 41 based on an output of a decoder DAC2 to which the correction data Cdata is input.

Figure 9:
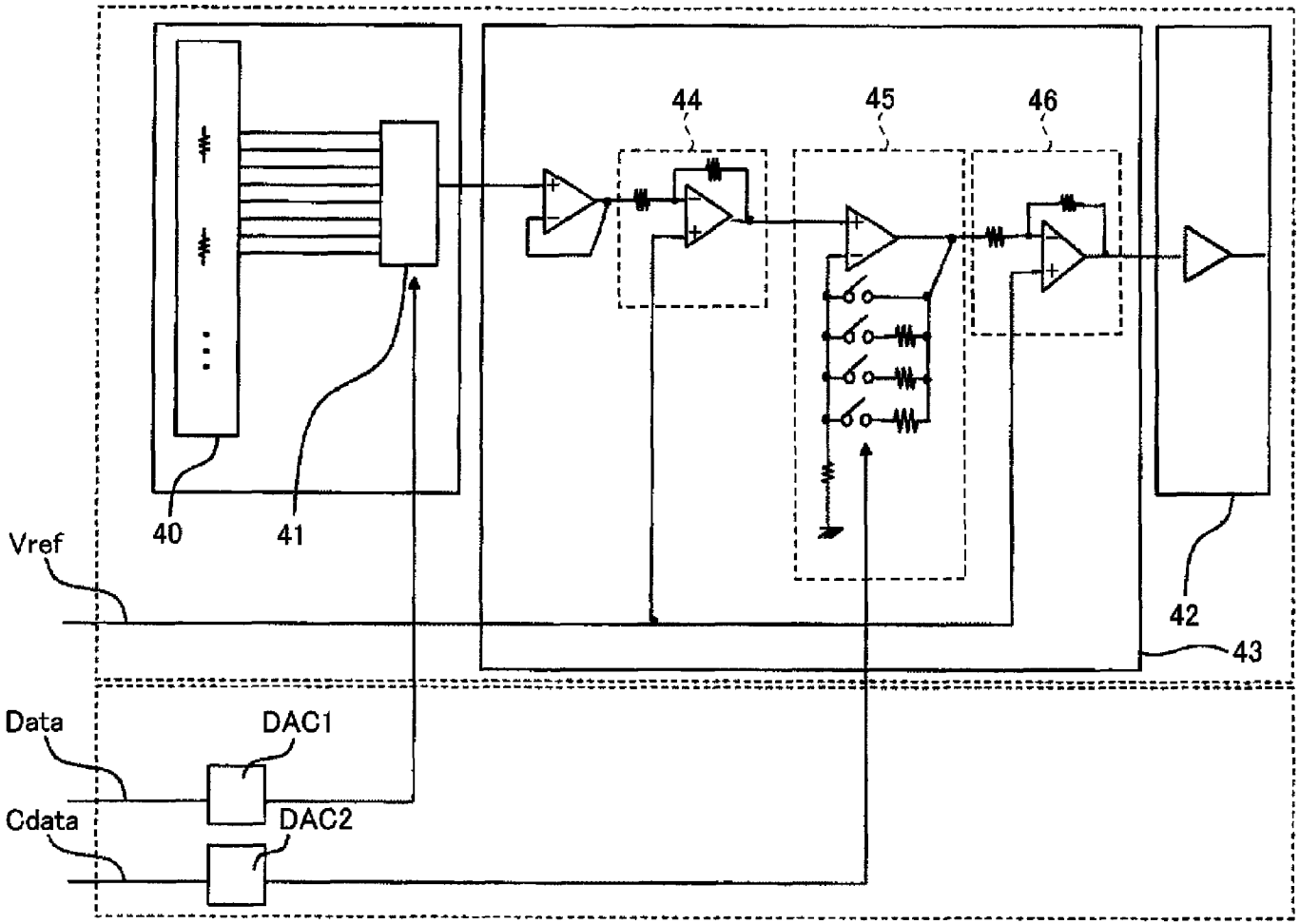
FIG. 9 is a block diagram illustrating a specific circuit structure of the output section of the signal driver circuit according to the embodiment of the present invention.

FIG. 9 is a block diagram illustrating a specific circuit structure of the output section of the signal driver circuit 11 according to the embodiment of the present invention. The circuit of FIG. 9 executes the calculations of Expressions (3) and (6).

In the circuit of FIG. 9, a subtraction circuit 44 including an operational amplifier subtracts an output of the selector 41 from the reference voltage Vref. A variable gain amplifier 45 including an operational amplifier multiplies a subtraction result from the subtraction circuit 44 by a light emission correction amount to the power of one half, or by the light emission correction amount. The subtraction circuit 44 and the variable gain amplifier 45 implement the calculations of the second terms of the right sides of Expressions (3) and (6). Lastly, a subtraction circuit 46 including an operational amplifier subtracts an output of the variable gain amplifier 45 from the reference voltage Vref, thereby completing the calculations of Expressions (3) and (6).

The amplification rate of the variable gain amplifier 45 is varied based on an output of the decoder DAC2 to which the correction data Cdata is input.

Figure 11:
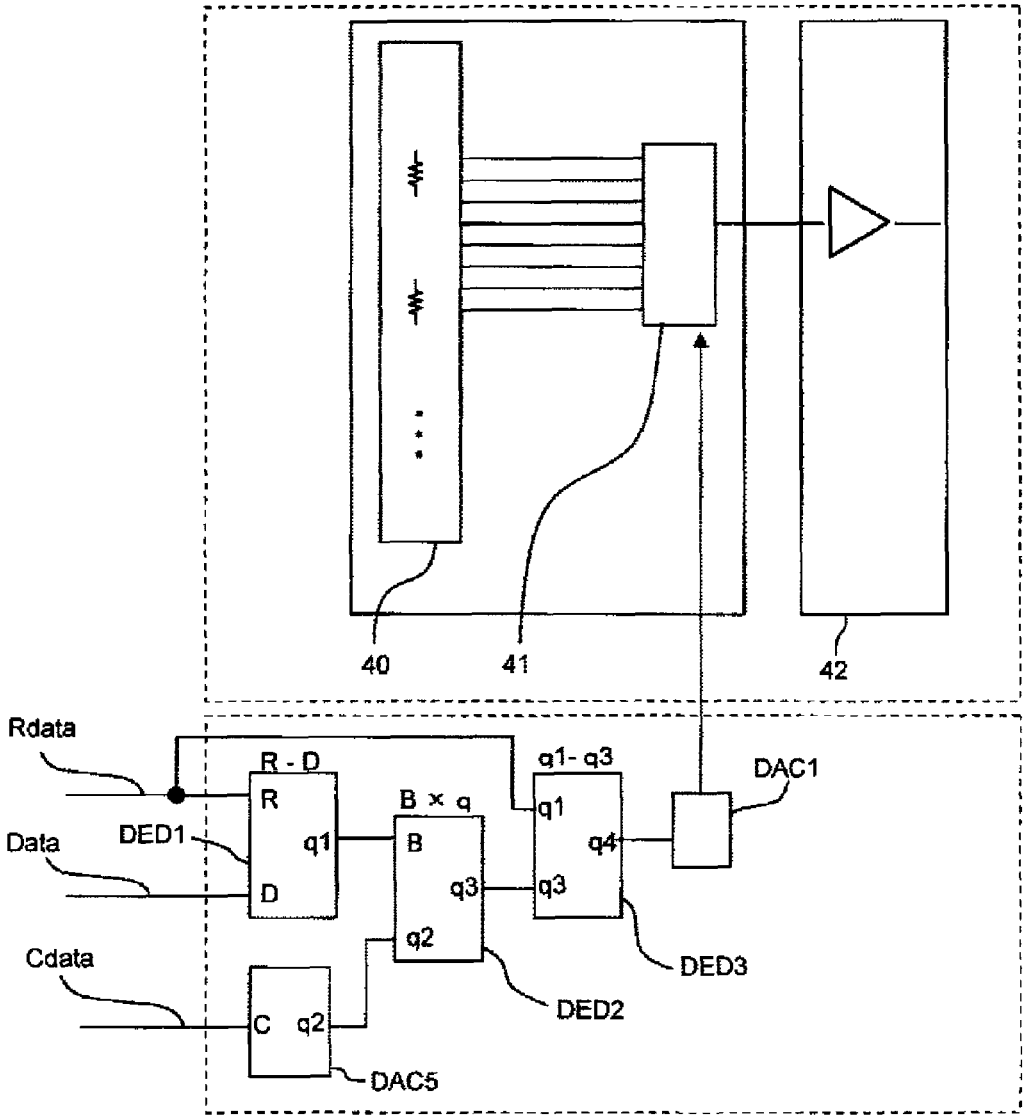
FIG. 11 is a block diagram illustrating still another circuit structure of the output section of the signal driver circuit according to the embodiment of the present invention.

FIG. 11 is a block diagram illustrating another circuit structure of the output section of the signal driver circuit 11 according to the embodiment of the present invention. The circuit of FIG. 11 uses a digital circuit to implement the circuit structure of FIG. 8.

In FIG. 11, denoted by Rdata is data of the reference voltage Vref. Denoted by DAC5 is a decoder to which the correction data Cdata is input. The decoder DAC5 outputs $(1/0.99)^{1/2}$ or (1/0.99).

Denoted by DED1 is an arithmetic circuit that calculates (Vref−Vdata). Denoted by DED2 is an arithmetic circuit that calculates $(\text{Vref}-\text{Vdata})\times(1/0.99)^{1/2}$, or $(\text{Vref}-\text{Vdata})\times(1/0.99)$. Denoted by DED3 is an arithmetic circuit that calculates $\{\text{Vref}-(\text{Vref}-\text{Vdata})\times(1/0.99)^{1/2}\}$, or $\{\text{Vref}-(\text{Vref}-\text{Vdata})\times(1/0.99)\}$.

Of components constituting the circuit of FIG. 11, the decoder DAC5 has a data table. The decoder DAC5 only has data for a stage to be corrected, and therefore is considerably reduced in data table amount compared to the prior art example.

As described above, the driver TFT 72 illustrated in FIGS. 2 and 5 has two driving methods, the current driving method and the voltage driving method, for different operation regions.

With the current driving method which corresponds to the region A of FIG. 7, a larger current can flow at a signal voltage of the same gradation and, the temperature characteristics of the driver TFT 72 are more stable than those of the organic EL element 1, and hence the TFT can operate stably against a change in surroundings.

With the voltage driving method which corresponds to the region C of FIG. 7, the voltage range necessary for driving can be set small, which makes low power consumption operation possible.

Emission mode switching is accordingly employed to use the current driving method in a normal light emission mode and to use the voltage driving method in a power saving mode or under a situation where the surroundings are dark.

Figure 10:
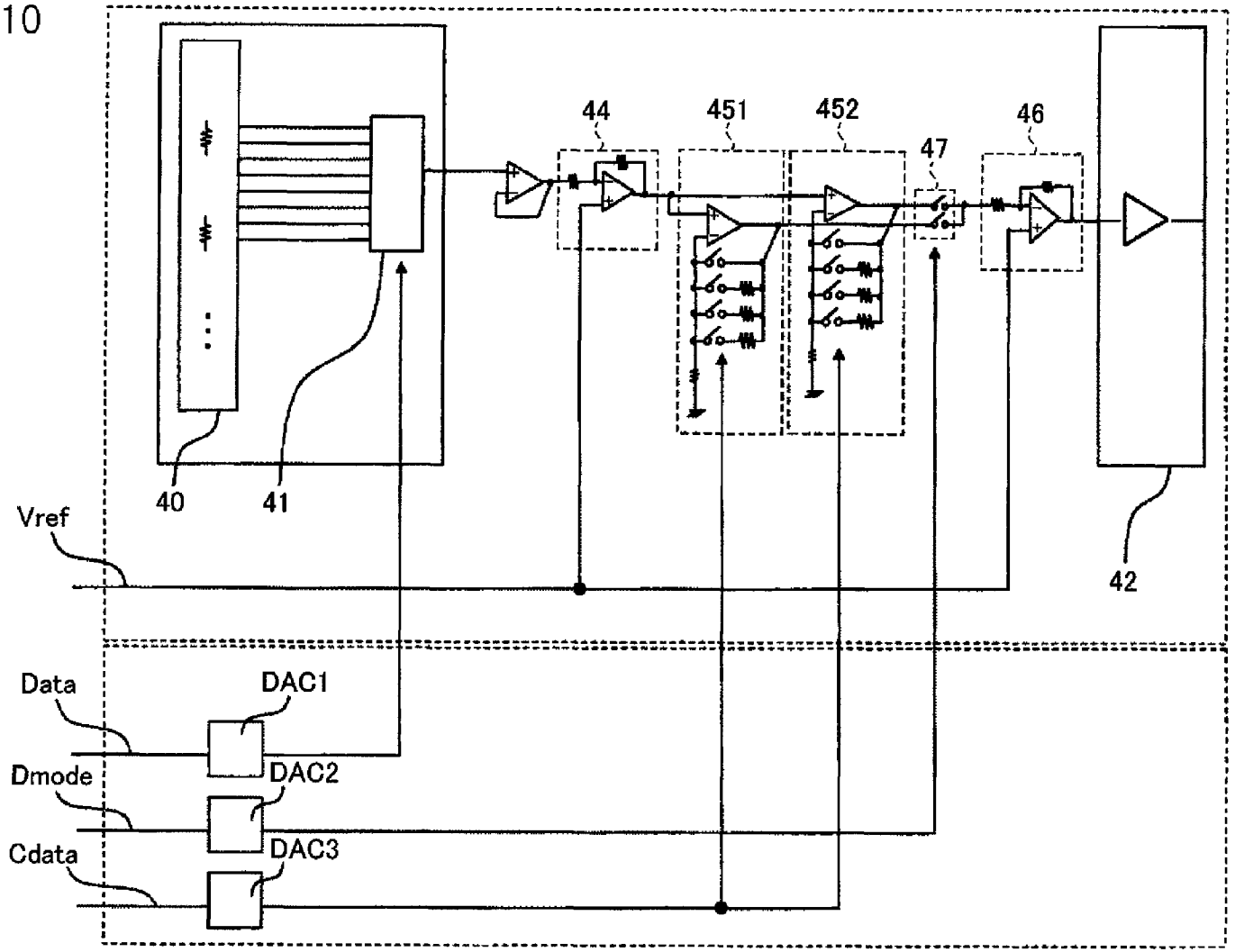
FIG. 10 is a block diagram illustrating another circuit structure of the output section of the signal driver circuit according to the embodiment of the present invention.

FIG. 10 is a block diagram illustrating still another circuit structure of the output section of the signal driver circuit 11 according to the embodiment of the present invention.

The circuit of FIG. 10 is capable of the emission mode switching described above. This circuit has a variable gain circuit 451, which multiplies by a light emission correction amount to the power of one half for the calculation of Expression (3), a variable gain circuit 452, which multiplies by a light emission correction amount for the calculation of Expression (6), and a switch circuit 47, which selects one of the variable gain circuits 451 and 452 arranged in parallel with each other. The switch circuit 47 is controlled by an output of a decoder DAC3 to which mode switching data Dmode is input, and makes a switch between an output of the variable gain circuit 451 and an output of the variable gain circuit 452 to select which output is to be input to a subtraction circuit 46.

Figure 12:
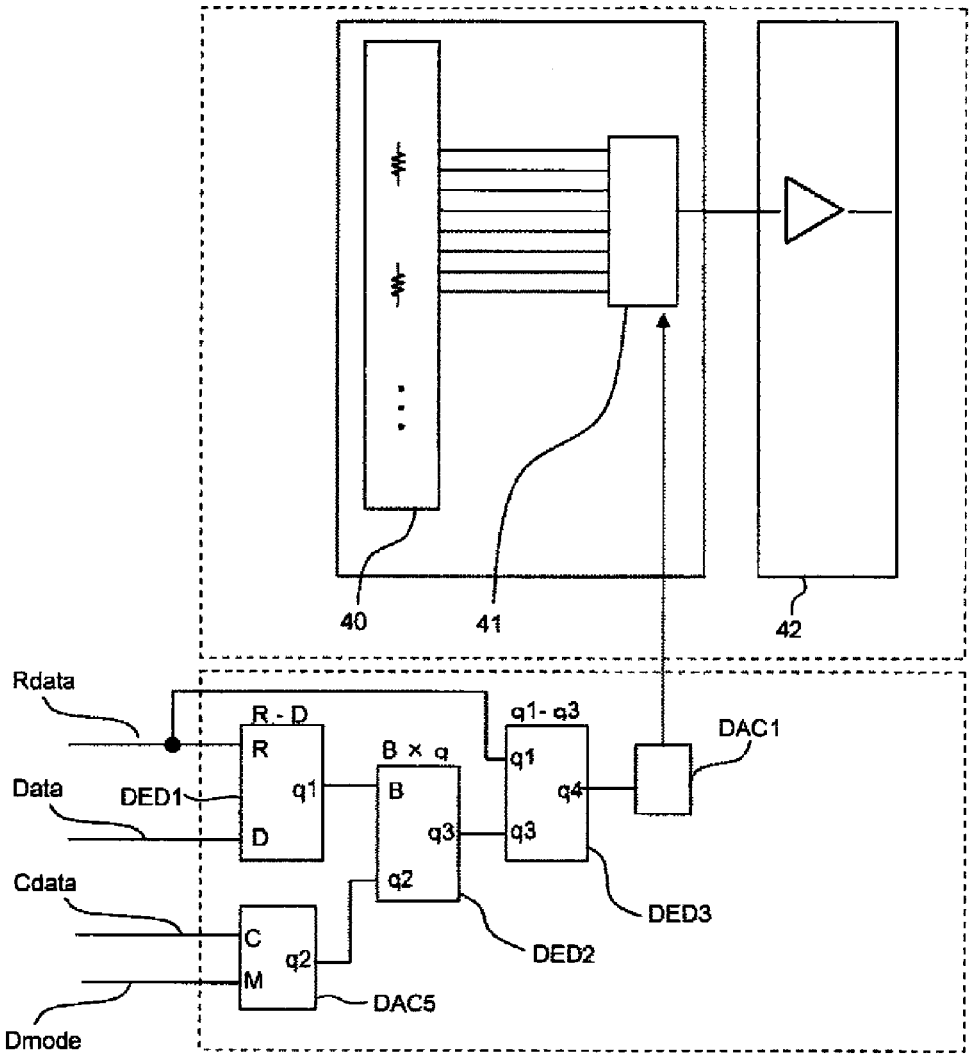
FIG. 12 is a block diagram illustrating yet still another circuit structure of the output section of the signal driver circuit according to the embodiment of the present invention.
Figure 13:
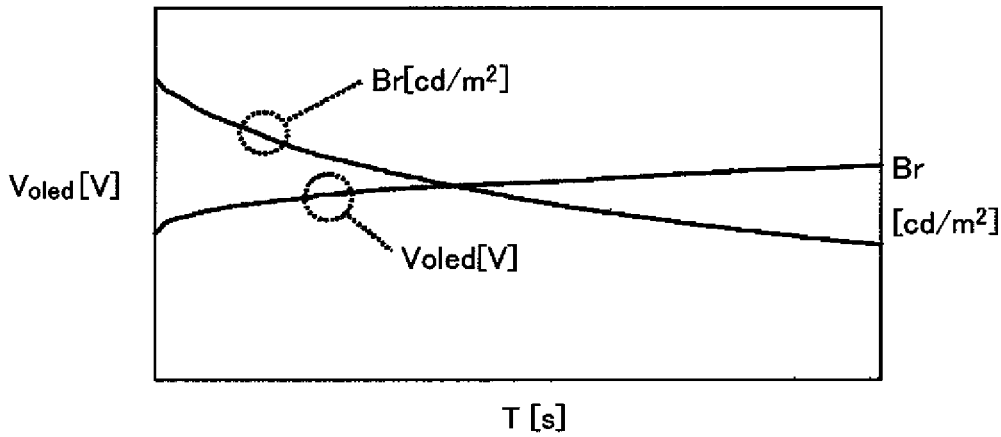
FIG.13 PRIOR ART
FIG. 13 is a graph illustrating changes with time in brightness and anode voltage of an organic EL element.

FIG. 12 is a block diagram illustrating yet still another circuit structure of the output section of the signal driver circuit 11 according to the embodiment of the present invention. The circuit of FIG. 12 is obtained by implementing the circuit structure of FIG. 10 with a digital circuit.

The circuit illustrated in FIG. 12 is the same as the circuit illustrated in FIG. 11 except that the mode switching data Dmode is input to the decoder DAC5 in addition to the correction data Cdata. A description on the circuit of FIG. 12 is therefore omitted here.

In this embodiment, whether or not the brightness has deteriorated by 1% is determined by the following method.

Figure 14:
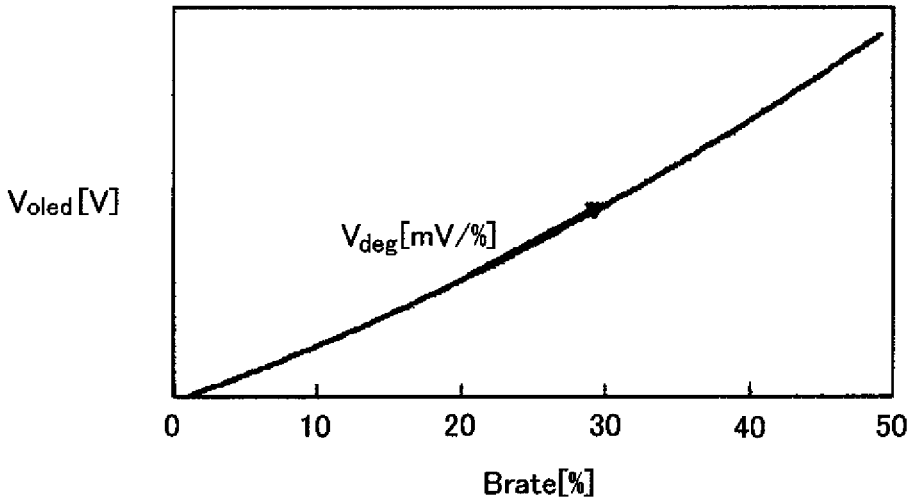
FIG.14 PRIOR ART
FIG. 14 is a graph illustrating a relation between a brightness deterioration rate and the anode voltage of the organic EL element.
Figure 15:
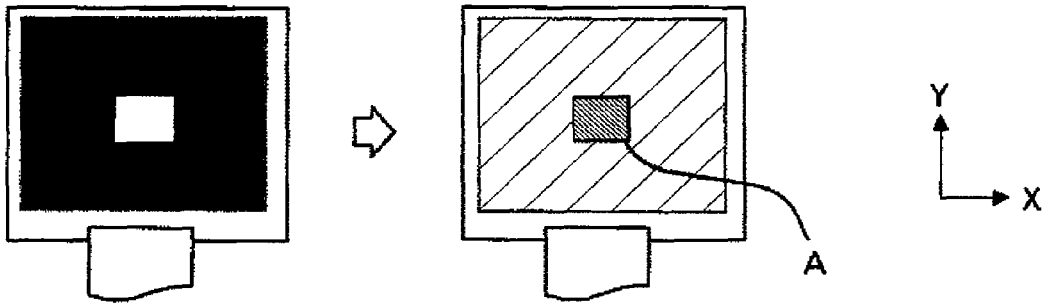
FIG.15 PRIOR ART
FIG. 15 is a schematic diagram illustrating how burn-in occurs in an organic EL display panel.
Figure 16:
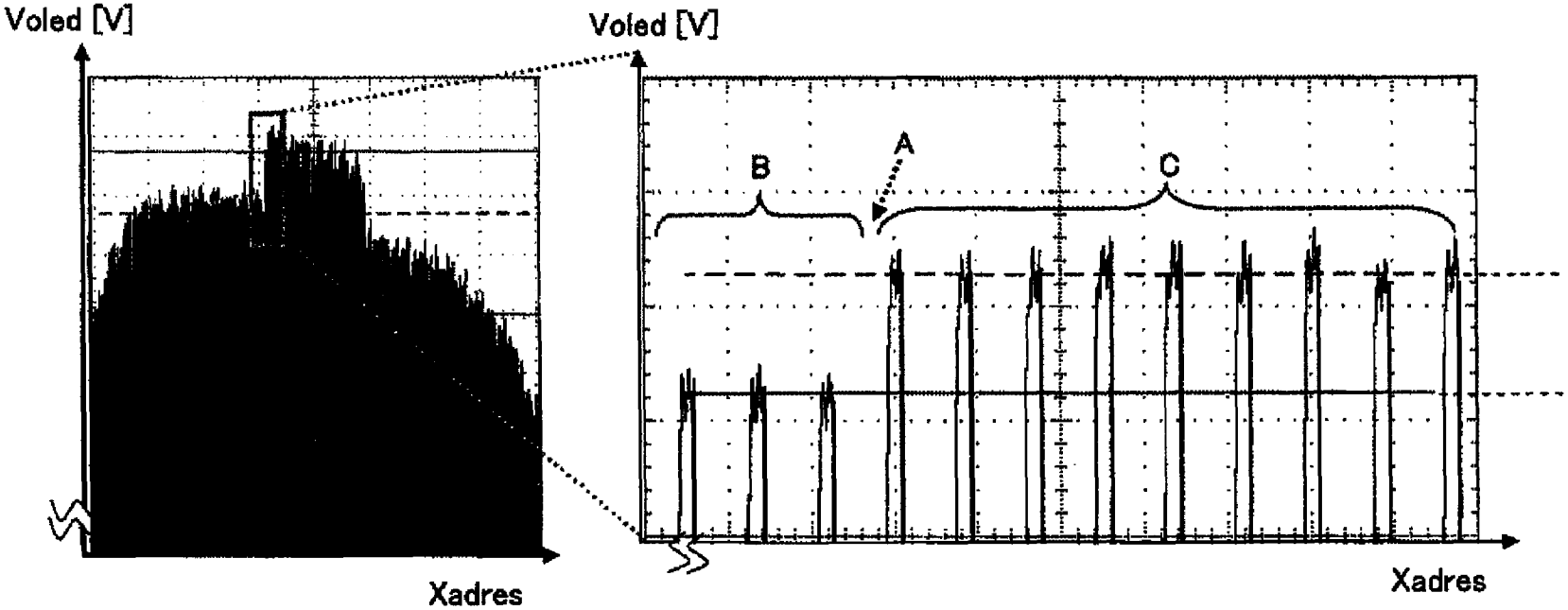
FIG.16 PRIOR ART
FIG. 16 is a diagram illustrating results obtained by scanning the anode voltage of organic EL elements along one display line after the burn-in has occurred in the organic EL display panel.

As illustrated in FIG. 14, the deterioration rate of the brightness (Brate of FIG. 14) of the organic EL element 1 and the anode voltage (Voled of FIG. 14) of the organic EL element 1 have a linear relationship. The analog-digital conversion circuit 23 of FIG. 1 is therefore used to detect the increment value (Vdeg of FIG. 14) of the anode voltage (Voled of FIG. 14) when the brightness has deteriorated by 1%.

The above-mentioned description deals with a case where the brightness has deteriorated by 1%. In the case where the brightness has deteriorated by $\alpha$%, the light emission correction amount is set to $[1/\{1-(\alpha/100)\}]^{1/2}$ or $[1/\{1-(\alpha/100)\}]$.

An image display device of the present invention described in the above-mentioned embodiment is capable of correcting the deterioration of a self-light-emitting element accurately.

A concrete description has been given through the above-mentioned embodiment on the invention made by the inventors of the present invention. The present invention, however, is not limited to the embodiment and can be modified in various ways without departing from the gist of the invention.

What is claimed is:

1. An image display device, comprising:

a plurality of pixels each including a self-light-emitting element and a driver transistor for driving the self-light-emitting element, the driver transistor being driven in a saturation region;

a plurality of signal lines through which an image voltage is input to the plurality of pixels;

detection means for detecting a difference in characteristics between the self-light-emitting elements of two adjacent pixels among the plurality of pixels;

a first calculation means for calculating a differential voltage between a reference voltage and the image voltage for the self-light-emitting element of the pixel that has been determined as a deteriorated self-light-emitting element by the detection means;

a second calculation means for multiplying a result of calculation made by the first calculation means by a non-linear light emission correction amount; and a third calculation means for subtracting a result of calculation made by the second calculation means from the reference voltage to obtain a corrected image voltage.

2. An image display device according to claim 1, wherein the detection means includes:

a constant current supplying circuit;

a voltage detection circuit for detecting, within a detection period, a voltage across the self-light-emitting element of each of the plurality of pixels, which is observed when a constant current is supplied from the constant current supplying circuit to the self-light-emitting element of each of the plurality of pixels;

an A/D converter for converting the voltage detected by the voltage detection circuit into a digital value;

a memory for storing the digital value output from the A/D converter; and a determination circuit for detecting, based on the digital value stored in the memory, the difference in characteristics between the self-light-emitting elements of the two adjacent pixels, and determining the deteriorated self-light-emitting element.

3. An image display device according to claim 2, wherein the non-linear light emission correction amount is one of increased and decreased to suit an emission brightness deterioration amount of the self-light-emitting element.

4. An image display device according to claim 3, wherein, when the determination circuit determines that the emission brightness deterioration amount of the self-light-emitting element is $\alpha$%, the non-linear light emission correction amount is $[1/\{1-(\alpha/100)\}]^{1/2}$.

5. An image display device according to claim 4, wherein the first calculation means is a first subtraction circuit which outputs the differential voltage between the reference voltage and the image voltage;

the second calculation means is an amplifier for amplifying, based on a determination of the determination circuit, an output of the first subtraction circuit with a gain $[1/\{1-(\alpha/100)\}]^{1/2}$; and the third calculation means is a second subtraction circuit which outputs a differential voltage between the reference voltage and an output of the amplifier.

6. An image display device according to claim 1, wherein the self-light-emitting element comprises an organic light emitting diode element.

7. An image display device, comprising:

a plurality of pixels each including a self-light-emitting element and a driver transistor for driving the self-light-emitting element, the driver transistor being driven in a linear region;

a plurality of signal lines through which an image voltage is input to the plurality of pixels;

detection means for detecting a difference in characteristics between the self-light-emitting elements of two adjacent pixels among the plurality of pixels;

a first calculation means for calculating a differential voltage between a reference voltage and the image voltage for the self-light-emitting element of the pixel that has been determined as a deteriorated self-light-emitting element by the detection means;

a second calculation means for multiplying a result of calculation made by the first calculation means by a linear light emission correction amount; and a third calculation means for subtracting a result of calculation made by the second calculation means from the reference voltage to obtain a corrected image voltage.

8. An image display device according to claim 7, wherein the detection means includes:

a constant current supplying circuit;

a voltage detection circuit for detecting, within a detection period, a voltage across the self-light-emitting element of each of the plurality of pixels, which is observed when a constant current is supplied from the constant current supplying circuit to the self-light-emitting element of each of the plurality of pixels;

an A/D converter for converting the voltage detected by the voltage detection circuit into a digital value;

a memory for storing the digital value output from the A/D converter; and a determination circuit for detecting, based on the digital value stored in the memory, the difference in characteristics between the self-light-emitting elements of the two adjacent pixels, and determining the deteriorated self-light-emitting element.

9. An image display device according to claim 8, wherein the linear light emission correction amount is one of increased and decreased to suit an emission brightness deterioration amount of the self-light-emitting element.

10. An image display device according to claim 9, wherein, when the determination circuit determines that the emission brightness deterioration amount of the self-light-emitting element is $\alpha$%, the linear light emission correction amount is $[1/\{1-(\alpha/100)\}]$.

11. An image display device according to claim 10, wherein the first calculation means is a first subtraction circuit which outputs the differential voltage between the reference voltage and the image voltage;

the second calculation means is an amplifier for amplifying, based on a determination of the determination circuit, an output of the first subtraction circuit with a gain $[1/\{1-(\alpha/100)\}]$; and the third calculation means is a second subtraction circuit which outputs a differential voltage between the reference voltage and an output of the amplifier.

12. An image display device according to claim 7, wherein the self-light-emitting element comprises an organic light emitting diode element.

13. An image display device, comprising:

a plurality of pixels each including a self-light-emitting element and a driver transistor for driving the self-light-emitting element;

a plurality of signal lines through which an image voltage is input to the plurality of pixels;

first driving means for driving the driver transistor in a saturation region;

second driving means for driving the driver transistor in a linear region;

detection means for detecting a difference in characteristics between the self-light-emitting elements of two adjacent pixels among the plurality of pixels;

a first calculation means for calculating a differential voltage between a reference voltage and the image voltage for the self-light-emitting element of the pixel that has been determined as a deteriorated self-light-emitting element by the detection means;

a second calculation means for multiplying a result of calculation made by the first calculation means by a non-linear light emission correction amount when the first driving means drives the driver transistor in the saturation region;

a third calculation means for subtracting a result of calculation made by the second calculation means from the reference voltage to obtain a corrected image voltage;

a fourth calculation means for multiplying the result of the calculation made by the first calculation means by a linear light emission correction amount when the second driving means drives the driver transistor in the linear region; and a fifth calculation means for subtracting a result of calculation made by the fourth calculation means from the reference voltage to obtain the corrected image voltage.

14. An image display device according to claim 13, wherein the detection means includes:

a constant current supplying circuit;

a voltage detection circuit for detecting, within a detection period, a voltage across the self-light-emitting element of each of the plurality of pixels, which is observed when a constant current is supplied from the constant current supplying circuit to the self-light-emitting element of each of the plurality of pixels;

an A/D converter for converting the voltage detected by the voltage detection circuit into a digital value;

a memory for storing the digital value output from the A/D converter; and a determination circuit for detecting, based on the digital value stored in the memory, the difference in characteristics between the self-light-emitting elements of the two adjacent pixels, and determining the deteriorated self-light-emitting element.

15. An image display device according to claim 14, wherein one of the non-linear light emission correction amount and the linear light emission correction amount is one of increased and decreased to suit an emission brightness deterioration amount of the self-light-emitting element.

16. An image display device according to claim 15, wherein, when the first driving means drives the driver transistor in the saturation region, and when the determination circuit determines that the emission brightness deterioration amount of the self-light-emitting element is $\alpha$%, the non-linear light emission correction amount is $[1/\{1(\alpha/100)\}]^{1/2}$; and when the second driving means drives the driver transistor in the linear region, and when the determination circuit determines that the emission brightness deterioration amount of the self-light-emitting element is $\alpha$%, the linear light emission correction amount is $[1/\{1-(\alpha/100)\}]$.

17. An image display device according to claim 16, wherein the first calculation means is a first subtraction circuit which outputs the differential voltage between the reference voltage and the image voltage;

the second calculation means is an amplifier for amplifying, based on a determination of the determination circuit, an output of the first subtraction circuit with a gain $[1/\{1-(\alpha/100)\}]^{1/2}$;

the third calculation means is a second subtraction circuit which outputs a differential voltage between the reference voltage and an output of the amplifier;

the fourth calculation means is an amplifier for amplifying, based on the determination of the determination circuit, the output of the first subtraction circuit with a gain $[1/\{1-(\alpha/100)\}]$; and the fifth calculation means is a third subtraction circuit which outputs a differential voltage between the reference voltage and an output of the amplifier.

18. An image display device according to claim 13, wherein the self-light-emitting element comprises an organic light emitting diode element.

* * * * *